US012213585B2

(12) United States Patent
Fitzgerald

(10) Patent No.: US 12,213,585 B2
(45) Date of Patent: Feb. 4, 2025

(54) FOLDING DESK

(71) Applicant: MECO Corporation, Greeneville, TN (US)

(72) Inventor: William Fitzgerald, Greeneville, TN (US)

(73) Assignee: MECO Corporation, Greeneville, TN (US)

( * ) Notice: Subject to any disclaimer, the term of this patent is extended or adjusted under 35 U.S.C. 154(b) by 0 days.

(21) Appl. No.: 17/725,513

(22) Filed: Apr. 20, 2022

(65) Prior Publication Data

US 2022/0330690 A1 Oct. 20, 2022

Related U.S. Application Data

(60) Provisional application No. 63/177,241, filed on Apr. 20, 2021.

(51) Int. Cl.
*A47B 3/08* (2006.01)

(52) U.S. Cl.
CPC .... *A47B 3/0803* (2013.01); *A47B 2003/0806* (2013.01)

(58) Field of Classification Search
CPC ..... A47B 3/0803; A47B 2003/0806
USPC ..... 108/134
See application file for complete search history.

(56) References Cited

U.S. PATENT DOCUMENTS 1,516,323 A * 11/1924 Bilton ..... A47B 1/08 108/79
2,587,177 A * 2/1952 Larson ..... B25H 1/04 144/286.1
3,009,752 A * 11/1961 Margulis ..... A47B 17/00 312/258
3,332,373 A * 7/1967 Ruiz ..... A47B 1/04 108/77
3,606,845 A * 9/1971 Hickman ..... A47B 3/0803 108/169
6,041,723 A * 3/2000 Peterson ..... A47B 5/06 108/115
6,314,892 B1 * 11/2001 Favini ..... A47B 3/0803 108/115
6,960,098 B1 * 11/2005 Tseng ..... H01R 13/73 439/502
6,997,115 B2 * 2/2006 Lockwood ..... A47B 3/0803 108/115
7,140,155 B1 * 11/2006 Nasimov ..... E04B 1/24 52/236.8

(Continued)

*Primary Examiner* — Daniel J Troy
*Assistant Examiner* — Timothy M Ayres
(74) *Attorney, Agent, or Firm* — McGuire Woods LLP

(57) ABSTRACT

A foldable desk that includes a fixed backframe and a fixed desktop portion connected to a top, horizontal portion of the fixed backframe. The desk also includes a foldable desktop portion rotatably connected to the fixed desktop portion. The foldable desktop portion is rotatable, in relation to the fixed desktop portion, between a folded position and an unfolded position. The foldable desktop portion in the folded position is substantially parallel to the fixed backframe and substantially perpendicular to the fixed desktop portion. The foldable desktop portion in the unfolded position is substantially coplanar with the fixed desktop portion and substantially perpendicular to the fixed backframe. The desk further includes at least one support frame rotatably connected to a bottom, vertical portion of the fixed backframe.

14 Claims, 3 Drawing Sheets

(56) References Cited

U.S. PATENT DOCUMENTS

| | | | | |
|---|---|---|---|---|
| 7,140,305 | B2 * | 11/2006 | Christians | A47B 3/002 108/115 |
| 7,337,728 | B2 | 3/2008 | Shabram et al. | |
| 7,360,260 | B2 * | 4/2008 | Gallawa | A47C 19/22 5/2.1 |
| 7,707,788 | B2 * | 5/2010 | Bystricky | E04H 9/0237 52/167.3 |
| 8,505,260 | B1 * | 8/2013 | Chang | E04H 9/0237 52/704 |
| 8,555,791 | B2 | 10/2013 | Jin et al. | |
| 8,701,359 | B2 * | 4/2014 | Packer | F16B 5/121 52/657 |
| 8,826,623 | B2 * | 9/2014 | Armstrong | E04C 3/02 52/656.9 |
| 8,857,352 | B2 | 10/2014 | Cohen | |
| 8,881,661 | B2 | 11/2014 | Tsai | |
| D757,464 | S * | 5/2016 | Chiang | D6/642 |
| 9,381,605 | B2 * | 7/2016 | Moyer | B23Q 3/18 |
| 9,504,318 | B1 * | 11/2016 | O'Keefe | H02G 3/18 |
| 9,681,747 | B1 * | 6/2017 | Pectol | A47B 13/083 |
| 9,713,375 | B1 | 7/2017 | Rahm | |
| 10,709,234 | B1 | 7/2020 | Brennan | |
| D910,342 | S * | 2/2021 | Li | D6/656 |
| 11,026,503 | B2 * | 6/2021 | O'Gara | A47B 23/044 |
| 2005/0257490 | A1 * | 11/2005 | Pryor | E04H 9/14 52/834 |
| 2009/0151608 | A1 | 6/2009 | Aldred et al. | |
| 2012/0047841 | A1 * | 3/2012 | Fyfe | E02D 27/50 52/695 |
| 2014/0165884 | A1 * | 6/2014 | O'Gara | A47B 3/002 108/115 |

* cited by examiner

FOLDING DESK

CROSS-REFERENCE TO RELATED APPLICATIONS

This application claims the benefit of and priority to U.S. Provisional Application No. 63/177,241, filed on Apr. 20, 2021, which is hereby incorporated by reference.

TECHNICAL FIELD

The present disclosure relates generally to furniture and specifically to desks that are strong, lightweight, portable and can be folded and unfolded easily.

BACKGROUND

Conventional folding desks include movable legs that are pivotally attached to a desktop. The legs are movable between a use position in which the legs extend outwardly from the desktop and a storage or porting position in which the legs are folded underneath the desktop. These folding desks, however, retain their relatively large size and shape even when the legs are in the collapsed position and are difficult to store or move or transport.

There is a need for folding desks that are strong, lightweight, portable and at the same time, can be folded and unfolded easily.

SUMMARY

According to one aspect of the present invention, there is provided a foldable desk that includes a fixed backframe and a first, or fixed desktop portion connected to a top, horizontal portion of the fixed backframe. The desk also includes a second, or foldable desktop portion rotatably connected to the fixed desktop portion. The foldable desktop portion is rotatable, in relation to the fixed desktop portion, between a folded position and an unfolded position. The foldable desktop portion in the folded position is substantially parallel to the fixed backframe and substantially perpendicular to the fixed desktop portion. The foldable desktop portion in the unfolded position is substantially coplanar with the fixed desktop portion and substantially perpendicular to the fixed backframe. The desk further includes at least one support frame rotatably connected to a bottom, vertical portion of the fixed backframe.

According to another aspect of the present invention, there is provided a method of using a foldable desk. The method includes the steps of rotating a first portion of the desktop relative to a second portion of the desktop such that the first portion and the second portion are substantially coplanar. The method also includes rotating a support frame about an axis perpendicular to the first and the second portions. The method further includes supporting the first portion of the desktop with the support frame.

BRIEF DESCRIPTION OF THE DRAWINGS

Illustrative examples of the present disclosure are described in detail below with reference to the attached drawing figures, which are incorporated by reference herein, and wherein.

Figure 1:
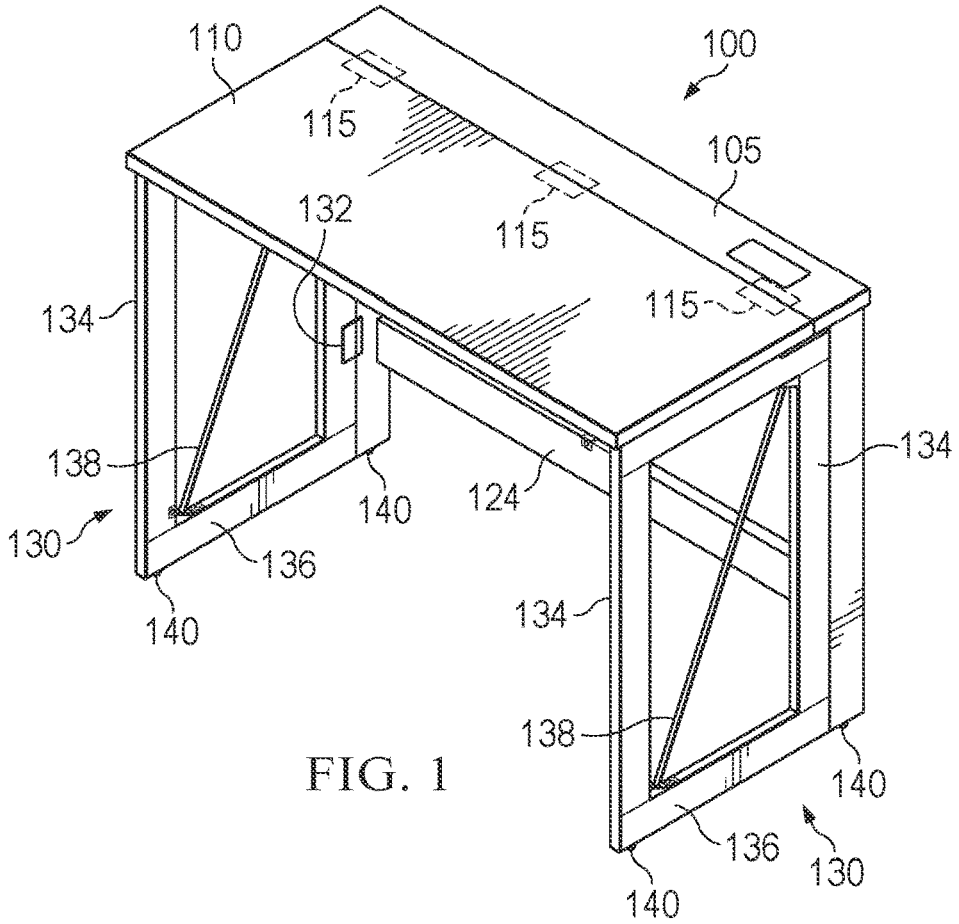
FIG. 1 illustrates a perspective view of a folding desk in an open position.

The illustrated figures are only exemplary and are not intended to assert or imply any limitation with regard to the environment, architecture, design, or process in which different examples may be implemented.

DETAILED DESCRIPTION

The present disclosure relates generally to furniture and specifically to desks that are strong, lightweight, portable and can be folded and unfolded easily.

In the following detailed description of several illustrative examples, reference is made to the accompanying drawings that form a part hereof, and in which is shown by way of illustration, examples that may be practiced. These examples are described in sufficient detail to enable those skilled in the art to practice them, and it is to be understood that other examples may be utilized, and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples is defined only by the appended claims.

Unless otherwise specified, any use of any form of the terms "connect," "engage," "couple," "attach," or any other term describing an interaction between elements is not meant to limit the interaction to direct interaction between the elements and may also include indirect interaction between the elements described. Further, any use of any form of the terms "connect," "engage," "couple," "attach," or any other term describing an interaction between elements includes items integrally formed together without the aid of extraneous fasteners or joining devices. In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

The examples described herein relate to a foldable desk that includes a first, or fixed desktop portion and a second, or foldable desktop portion. The surface area of the foldable desktop portion is larger than the surface area of the fixed desktop portion. In one aspect, the foldable desktop portion has a surface area three times the surface area of fixed desktop portion. In one aspect, the foldable desktop portion has a surface area four times the surface area of fixed desktop portion. In one other aspect, the foldable desktop portion has a surface area greater than four times the surface area of fixed desktop portion.

The first, or fixed desktop portion is connected to a top, horizontal portion of a fixed backframe. The second, or foldable desktop portion is rotatably connected to the fixed desktop portion. The foldable desktop portion is rotatable, in relation to the fixed desktop portion, between a folded position and an unfolded position. The foldable desktop portion in the folded position is substantially parallel to the fixed backframe and substantially perpendicular to the fixed desktop portion. The foldable desktop portion in the unfolded position is substantially coplanar with the fixed desktop portion and substantially perpendicular to the fixed backframe. The desk further includes at least one support frame rotatably connected to a bottom, vertical portion of the fixed backframe.

The support frames are rotatable between a folded position and an unfolded position. The support frames, in the folded position, are parallel to the fixed backframe and perpendicular to the fixed desktop portion. Further, the support frames in the unfolded position, are parallel to the fixed desktop portion and perpendicular to the fixed backframe. The support frames, when folded, are releasably connected to the fixed backframe by a first releasable retaining mechanism. The foldable desktop portion, when folded, is releasably connected to the folded support frames by a second releasable retaining mechanism. When unfolded, the support frames are releasably connected to the unfolded desktop portion by a third releasable retaining mechanism.

Various aspects of the present disclosure are described below as they might be employed in a folding desk. In the interest of clarity, not all features of an actual implementation are described in this specification. It will of course be appreciated that in the development of any such actual implementation, numerous implementation-specific decisions must be made to achieve the developers' specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

Advantages of the various aspects of the present disclosure will become apparent from consideration of the following description and drawings. The following description and drawings may repeat reference numerals and/or letters in the various examples or figures. This repetition is for the purpose of simplicity and clarity and does not in itself dictate a relationship between the various embodiments and/or configurations discussed.

Figure 2:
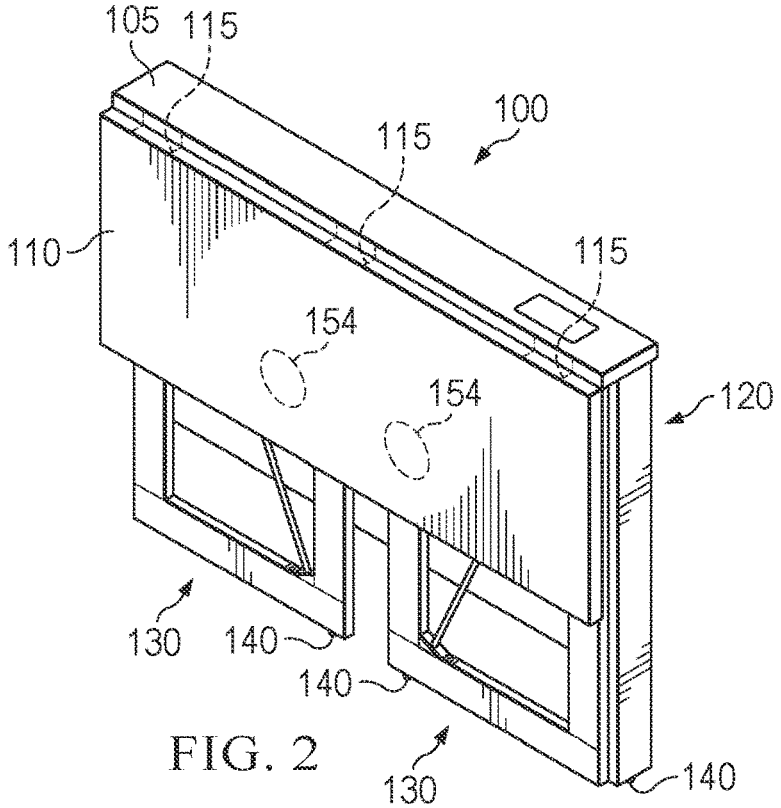
FIG. 2 illustrates a perspective view of the folding desk of FIG. 1, in a closed position.

FIG. 1 is a perspective view of a foldable desk 100 in an open (also referred to as "horizontal" or "unfolded" or "extended") position. FIG. 2 is a perspective view of the foldable desk 100 of FIG. 1, in a closed (also referred to as "vertical" or "folded" or "collapsed") position. It is more convenient to handle the foldable desk 100 in a closed position, for storage or for transport purpose. In one aspect, the folding desk 100 may be pre-assembled requiring no assembly by an end user and the user directly opens and uses the folding desk 100.

Referring to FIGS. 1 and 2, the foldable desk 100 include a fixed desktop portion 105 and a foldable desktop portion 110 rotatably mounted to the fixed desktop portion 105. In FIG. 2, the foldable desktop portion 110 is shown rotated (or swung) to a down or closed position, no longer extending horizontally in a same plane (or coplanar) as the fixed desktop portion 105 and is rather substantially perpendicular to the fixed desktop portion 105.

The foldable desktop portion 110 and the fixed desktop portion 105 are connected by one or more (e.g., three) connecting mechanisms 115. The three connecting mechanisms 115 permit the foldable desktop portion 110 to swing down or rotate from a horizontal position to a vertical position. The three connecting mechanisms 115 may be hinge type connectors, clasp type connectors or strapped connectors. In one aspect, the connecting mechanisms 115 may be window hinges, knife hinges, piano hinges or barrel hinges. In one aspect, the connecting mechanisms 115 may be pivot hinges, butt hinges or strap hinges. In one other aspect, the connecting mechanisms 115 may be mechanical hinges, heavy duty hinges or concealed hinges.

The surface area of the foldable desktop portion 110 is larger than the surface area of the fixed desktop portion 105. In one aspects, the foldable desktop portion 110 has a surface area three times the surface area of fixed desktop portion 105. In one aspect, the foldable desktop portion 110 has a surface area four times the surface area of fixed desktop portion 105. In one other aspect, the foldable desktop portion 110 has a surface area greater than four times the surface area of fixed desktop portion 105.

Figure 4:
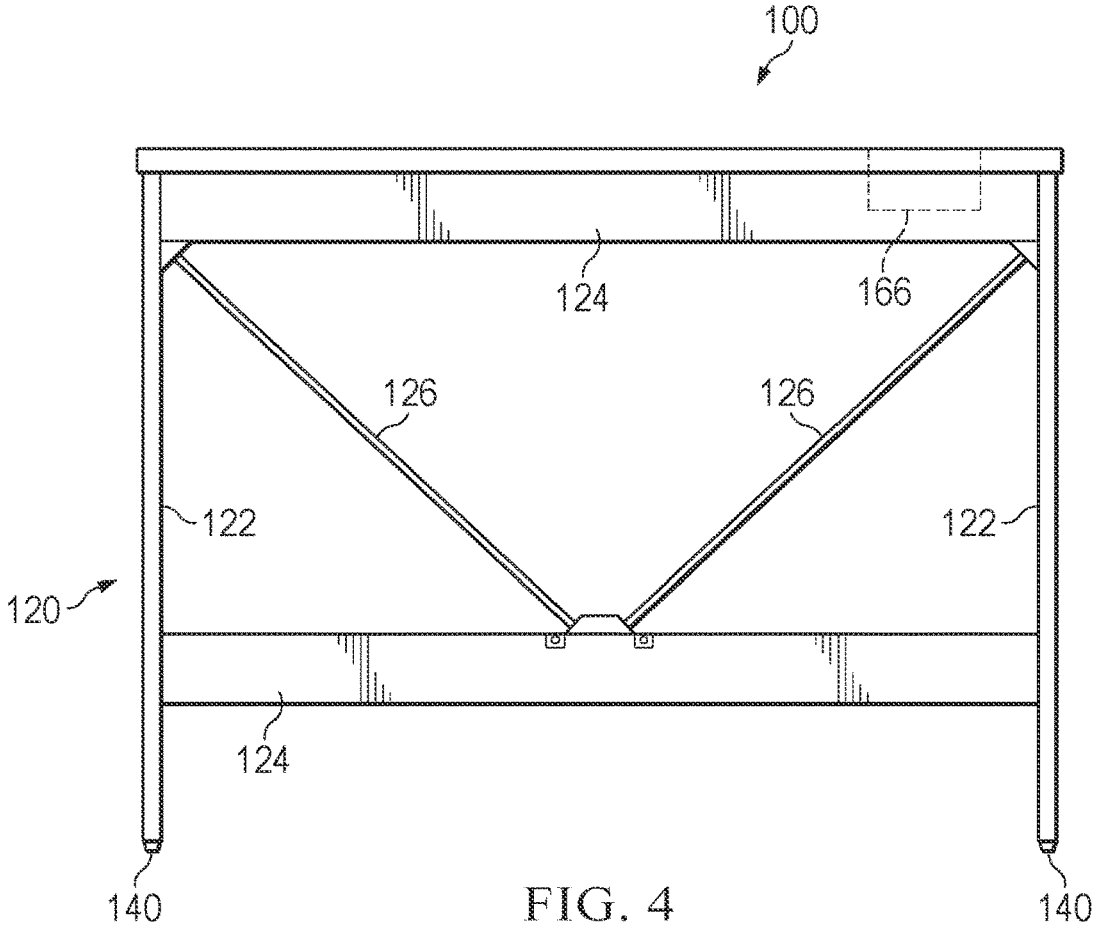
FIG. 4 illustrates a rear view of the folding desk of FIG. 1, in an open position.

The fixed desktop portion 105 is mounted on and supported by a fixed backframe 120 (described in more detail in FIG. 4). The foldable desktop portion 110, in the folded position, is parallel to the fixed backframe 120 and perpendicular to the fixed desktop portion 105. Conversely, the foldable desktop portion 110, in the unfolded position, is supported by at least one (e.g., two) support frame 130, coplanar with the fixed desktop portion 105 and perpendicular to the fixed backframe 112. The support frames 130 are rotatably connected with the fixed backframe 120.

The fixed backframe 120 and the support frames 130 include independently adjustable foot components 140 at the base (also known in the industry as "glides"). The foot components (or the glides) 140 are capable of being independently raised or lowered and are adjusted, thereby, to level the foldable desk 100. In one aspect, the foot components (or the glides) 140 are turned clockwise to lower the respective corners. Conversely, the foot components (or the glides) 140 are turned counter-clockwise to raise the respective corners.

Figure 3:
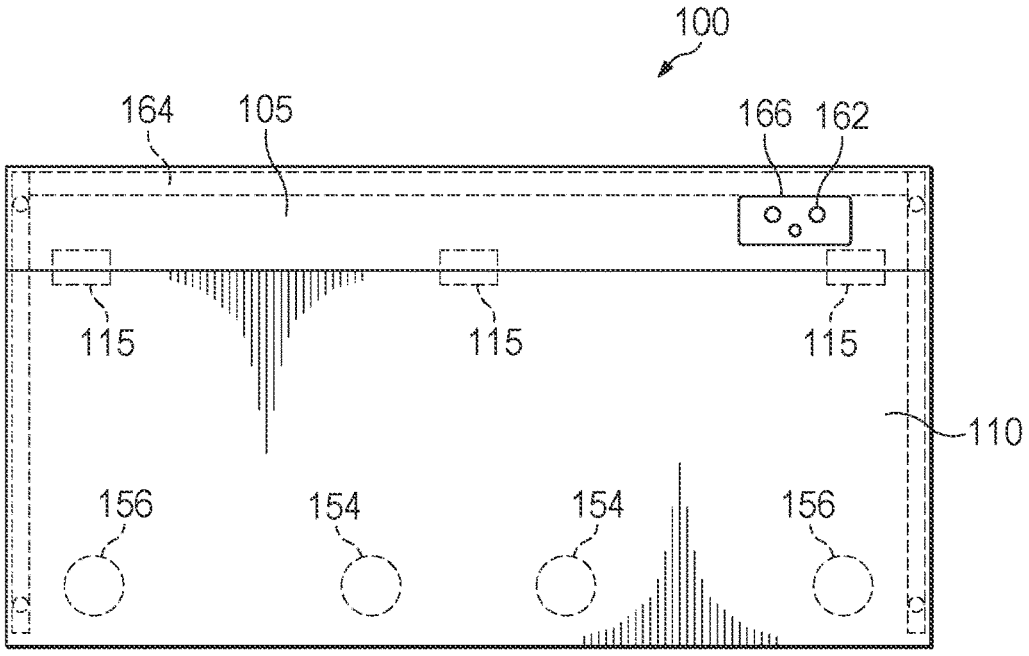
FIG. 3 illustrates a top view of the folding desk of FIG. 1, in an open position.

FIG. 3 is a top plan view of the foldable desk 100, in an open position, showing the surface of the foldable desktop portion 110. The foldable desk 100 includes at least one electrical interface 162 configured to connect at least one electrical device (e.g., a laptop computer, not shown). The foldable desk 100 further includes an electrical access area 164 configured to connect the electrical device to an electrical power source (not shown). In one aspect, the electrical access area 164, may include a compartment 166, as shown, located within the fixed desktop portion 105 to provide universal serial bus (USB) connectivity and/or power connectivity (e.g., 105-volt AC). The compartment 166 may include the respective one or more electrical power (e.g., plug) interfaces 162. An exemplary power cord is held in place by hook and loop tape. In operation, a user can loosen and separate the tape to drop the power cord and the power cord can then be plugged into a 105-volt household power receptacle.

FIG. 4 is a rear view of the foldable desk 100, in an open position, showing a standing or vertical view of the fixed backframe 120. The fixed backframe 120 includes at least two backframe longitudinal posts 122 generally expending in a longitudinal direction. The fixed backframe 120 also includes at least one (e.g., two) backframe transverse post 124. The backframe transverse posts 124 generally expend in a transverse direction perpendicular to the longitudinal direction and are connected to the backframe longitudinal posts 122. The fixed backframe 120 further includes at least one (e.g., two) backframe diagonal post 126 diagonally connected to the backframe longitudinal posts 122 and to the backframe transverse posts 124. The fixed backframe longitudinal posts 122, transverse posts 124 and diagonal posts 126 may be tubular, and may be made of a metal, a composite, wood, or the like.

Figure 6:
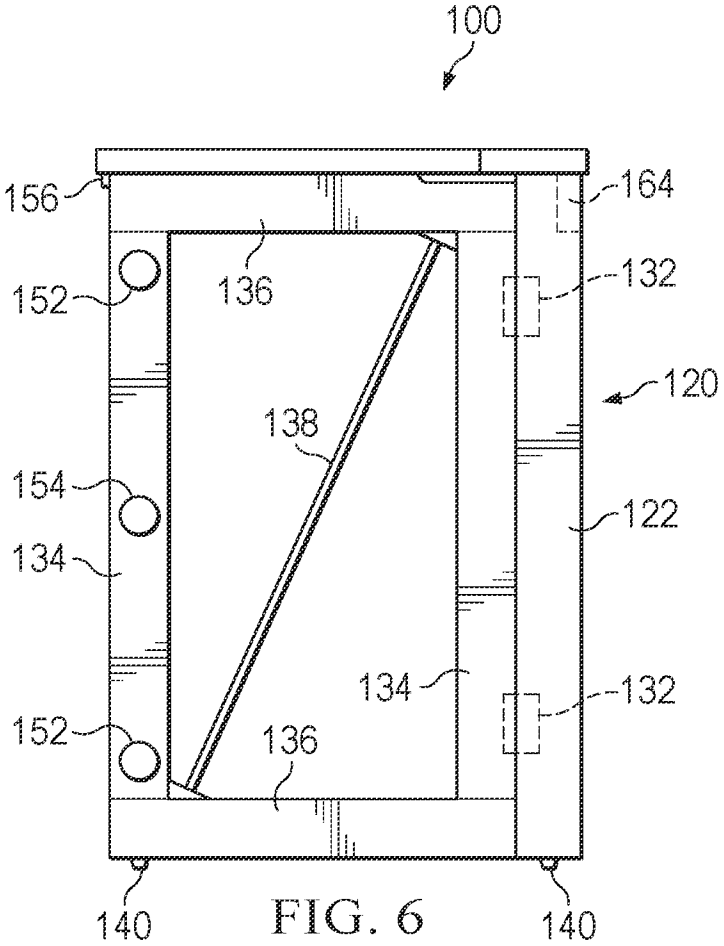
FIG. 6 illustrates another side view of the folding desk of FIG. 1, in an open position and from the opposite side of FIG. 5.
Figure 5:
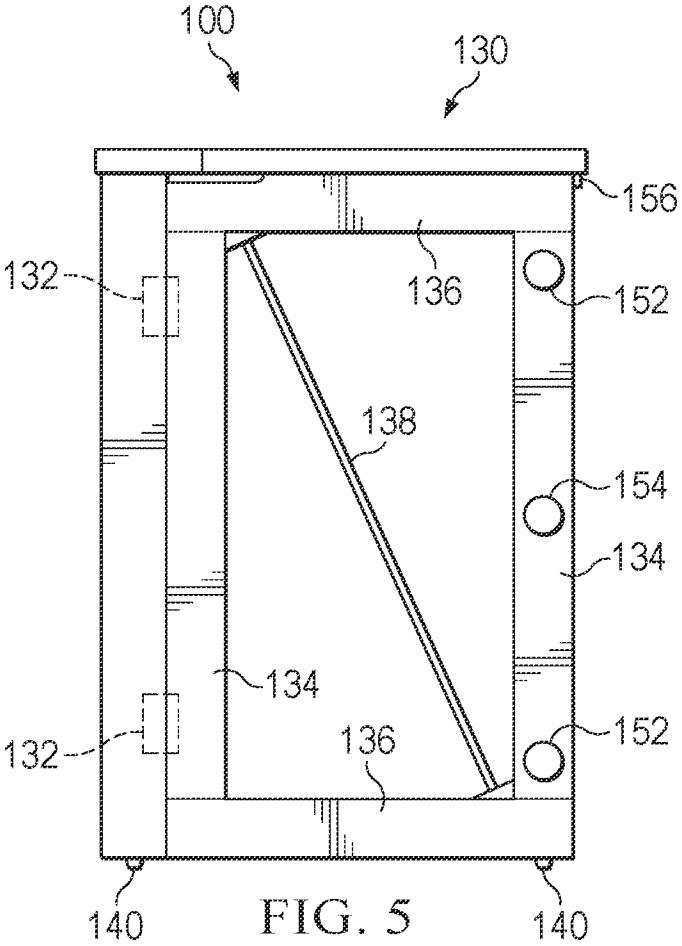
FIG. 5 illustrates a side view of the folding desk of FIG. 1, in an open position.

FIG. 5 illustrates a side view of the folding desk 100 of FIG. 1. FIG. 6 illustrates another side view of the folding desk 100 of FIG. 1, from the opposite side of FIG. 5. Referring to FIGS. 5 and 6, there are two rectangular-shaped support frames 130 at opposite ends of the foldable desk 100, each attached to the fixed backframe 120 by at least two attaching mechanisms 132. Each of the rectangular-shaped support frames 130 may be rotated independently via attaching mechanisms 132 to permit opening and closing the foldable desk 100.

Specifically, the support frames 130 are independently rotatable between a folded position and an unfolded position. The support frames 130, in the folded position, are substantially parallel to the fixed backframe 120 and the fixed desktop portion 105. Conversely, the support frames 130, in the unfolded position, are substantially parallel to the fixed desktop portion 105 and substantially perpendicular to the fixed backframe 120. In the unfolded position, the rectangular-shaped support frames 130 support the foldable desktop portion 110 from below.

Continuing to refer to FIGS. 5 and 6, the support frames 130 include at least two support frame longitudinal (shown as vertical) posts 134 generally expending in a longitudinal direction. The support frames 130 also include at least one support frame transverse (shown as horizontal) post 136 generally expending in a transverse direction perpendicular to the longitudinal direction and connected to the longitudinal support frame posts 134. The rear support frame longitudinal posts 134 may connect with the fixed desktop portion 105 and may be held spaced-apart from one another by the support frame transverse posts 136. The support frames 130 further include at least one (e.g., two) support frame diagonal post 138, diagonally connected to the support frame longitudinal posts 134 and to the support frame transverse posts 136. The support frame longitudinal posts 134, transverse posts 136 and diagonal posts 138 may be tubular, and may be made of a metal, a composite, wood, or the like.

The support frames 130, in the folded position, are releasably connected to the fixed backframe 120 by a first releasable retaining mechanism 152. The foldable desktop portion 110, in the folded position, is releasably connected to the support frames 130 (in the folded position) by a second releasable retaining mechanism 154. Further, the support frames 130, in the unfolded position, are releasably connected to the foldable desktop portion 110 (unfolded) by a third releasable retaining mechanism 156. In one aspect, one or more of the releasable retaining mechanisms 152, 154, and 156 may be a snap-type connector. In another aspect, one or more of the releasable retaining mechanisms 152, 154, and 156 may be a magnetic attachment or similar other releasable connector(s). In one aspect, the magnetic attachments may include two oppositely poles magnets. In one aspect, the magnetic attachments may include one (or more) magnetic plate(s) attached to the support frames 130 and one (or more) ferro-magnetic plate(s) attached to the fixed backframe 120 or the foldable desktop portion 110. In one other aspect, the magnetic attachments may include one (or more) magnetic plate(s) attached to the fixed backframe 120 or the foldable desktop portion 110 and one (or more) ferro-magnetic plate(s) attached to the support frames 130, or any other combination possible.

Referring to FIGS. 1 to 6, in an exemplary unfolding operation, the fixed desktop portion 105 is lifted and held atop with one hand while one of the support frames 130 is swung out. The fixed desktop portion 105 is allowed to rest on the unfolded support frame 130 and the support frame 130 is adjusted below the fixed the desktop portion 105 to releasably lock (or click) into place with a mating retaining mechanism in the fixed desktop portion 105. Next, the other support frame 130 is swung out and adjusted below the fixed the desktop portion 105 to releasably lock (or click) into its place with the other mating retaining mechanism in the fixed desktop portion 105. The desk becomes ready for use. In one aspect, the retaining mechanism in the fixed desktop portion 105 may be a snap-type connector or a clasp type or a spring-loaded connector. In another aspect, the retaining mechanism may be a magnetic attachment or similar other releasable connector(s), as described above.

Further, referring once more to FIGS. 1 to 6, in an exemplary folding operation, the fixed desktop portion 105 is lifted slightly and held atop, releasing the support frames 130 from their respective retaining mechanism. With one hand, one of the support frames 130 is swung in till it reaches the surface of the fixed backframe 120 and releasably locks (or clicks) into place with a mating retaining mechanism in the fixed backframe 120. Next, the other support frame 130 is swung in till it reaches the surface of the fixed backframe 120 and releasably locks (or clicks) into place with its mating retaining mechanism in the fixed backframe 120. The fixed desktop portion 105 is allowed to swing or rotate down and rest on the folded support frames 130. Next, the fixed desktop portion 105 is allowed to releasably lock (or latch or click) into place with its mating retaining mechanisms in the support frames 130. The desk is now ready to be stored.

In some embodiments, while different steps, processes, and procedures are described as appearing as distinct acts, one or more of the steps, one or more of the processes, and/or one or more of the procedures may also be performed in different orders, simultaneously and/or sequentially. In some embodiments, the steps, processes, and/or procedures may be merged into one or more steps, processes and/or procedures.

In some embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

It is to be understood that the folding desk and its components as depicted in FIGS. 1-6 are only one possible configuration of the folding desk. As such, it is to be recognized that the illustrated folding desk is merely exemplary in nature, and various additional configurations may be used that have not necessarily been depicted in FIGS. 1-6 in the interest of clarity. In an exemplary design, the folding desk 100 has a length of 40 inches, width of 20 inches and height of 30 inches. The dimensions of the other parts and components are proportionately decided. The dimensions shown in the drawings are exemplary and may vary in design and scale, from one instance to another. An exemplary, non-limiting, maximum load capacity of the folding desk 100 is 100 pounds. Moreover, non-limiting additional components may be present, including, but not limited to, ornamental and decorative tops and embossing, logos, and the like. As such, it should be clearly understood that the examples illustrated by FIGS. 1-6 are merely a general application of the principles of this disclosure in practice, and a wide variety of other examples are possible. Therefore, the scope of this disclosure is not limited in any manner to the details of FIGS. 1-6 as described herein.

Provided is a method of using a foldable desk. The method includes the steps of rotating a first portion of the desktop relative to a second portion of the desktop such that the first portion and the second portion are coplanar, rotating a support frame about an axis perpendicular to the first and the second portions, and supporting the first portion of the desktop with the support frame. Supporting the first portion of the desktop with the support frame includes releasably connecting the support frame to the first portion of the desktop.

Additionally, or alternatively, the method may include one or more of the following features individually or in combination.

A surface area of the first portion of the desktop is larger than a surface area of the second portion of the desktop.

The method may further include independently raising or lowering at least one corner of the support frame to level the foldable desk.

The method may further include releasing the first portion of the desktop from the support of the support frame, rotating the support frame about the axis such that the support frame and the second portion are perpendicular, and rotating the first portion of the desktop relative to the second portion of the desktop such that the first portion and the second portion are perpendicular.

The method may further include releasably connecting the first portion of the desktop to the support frame.

The method may further include rigidly connecting the second portion of the desktop to a fixed backframe.

The method may further include releasably connecting the support frame to the fixed backframe.

The method may further include exposing an electrical outlet in the first or the second portion of the desktop.

The method may further include electrically connecting a power cord in the electrical outlet.

Provided is a foldable desk that includes a fixed backframe and a fixed desktop portion connected to a top, horizontal portion of the fixed backframe. The desk also includes a foldable desktop portion rotatably connected to the fixed desktop portion. The foldable desktop portion is rotatable, in relation to the fixed desktop portion, between a folded position and an unfolded position. The foldable desktop portion in the folded position is substantially parallel to the fixed backframe and substantially perpendicular to the fixed desktop portion. The foldable desktop portion in the unfolded position is substantially coplanar with the fixed desktop portion and substantially perpendicular to the fixed backframe. The desk further includes at least one support frame rotatably connected to a bottom, vertical portion of the fixed backframe.

Additionally, or alternatively, the folding desk may include one or more of the following features individually or in combination.

The surface area of the foldable desktop portion is larger than the surface area of the fixed desktop portion.

The at least one support frame and the fixed backframe includes at least one independently adjustable foot component at the base. The foot component is capable of being independently raised or lowered and thereby is capable of leveling the foldable desk.

The fixed backframe includes at least two backframe longitudinal posts generally expending in a longitudinal direction and at least one backframe transverse post connected to the at least two backframe longitudinal posts and generally expending in a transverse direction perpendicular to the longitudinal direction. The fixed backframe also includes at least one backframe diagonal post diagonally connected to the at least two backframe longitudinal posts and to the at least one backframe transverse post.

The foldable desk includes at least one electrical interface configured to connect at least one electrical device and an electrical access area configured to connect the at least one electrical device to an electrical power source.

The at least one support frame is rotatable between a folded position and an unfolded position. The at least one support frame in the folded position is substantially parallel to the fixed backframe and substantially perpendicular to the fixed desktop portion. Further, the at least one support frame in the unfolded position is substantially parallel to the fixed desktop portion and substantially perpendicular to the fixed backframe. The at least one support frame is configured to support the foldable desktop portion from beneath.

The at least one support frame in the folded position is releasably connected to the fixed backframe by a first releasable retaining mechanism.

The foldable desktop portion in the folded position is releasably connected to the at least one support frame in the folded position by a second releasable retaining mechanism.

The at least one support frame in the unfolded position is releasably connected to the foldable desktop portion in the unfolded position by a third releasable retaining mechanism.

The at least one support frame includes at least two support frame longitudinal posts generally expending in a longitudinal direction and at least one support frame transverse post connected to the at least two longitudinal support frame posts and generally expending in a transverse direction substantially perpendicular to the longitudinal direction. The at least one support frame further includes at least one support frame diagonal post diagonally connected to the at least two support frame longitudinal posts and to the at least one support frame transverse post.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps. The systems and methods can also "consist essentially of" or "consist of the various components and steps." Moreover, the indefinite articles "a" or "an," as used in the claims, are defined herein to mean one or more than one of the element that it introduces.

Element list

100 Perspective view of foldable desk in an unfolded position
105 Fixed desktop portion
110 Foldable desktop portion
115 Connecting mechanism
120 Fixed backframe
122 Backframe longitudinal post
124 Backframe transverse post
126 Backframe diagonal post
130 Support frame
132 Attaching mechanism
134 Support frame longitudinal post
136 Support frame transverse post

138 Support frame diagonal post
140 Foot component
152 First releasable retaining mechanism
154 Second releasable retaining mechanism
156 Third releasable retaining mechanism
162 Electrical interface
164 Electrical access areap
166 Electrical interface compartment

What is claimed is:

1. A foldable desk comprising:

a fixed backframe comprising;

at least two backframe longitudinal posts generally expending in a longitudinal direction, at least one backframe transverse post connected to the at least two backframe longitudinal posts and generally expending in a transverse direction perpendicular to the longitudinal direction, and two backframe diagonal posts diagonally nected to the at least two backframe longitudinal posts and to the at least one backframe transverse post, the two backframe diagonal posts converging a fastener positioned at a midpoint of a re pective one of the at least one backframe transverse post:

a fixed desktop portion connected to a top, horizontal portion of the fixed backframe, the fixed desktop portion sized to accommodate and including a compartment to provide electrical connectivity to an electrical interface accessible through a top of the fixed desktop portion, the electrical interface configured to connect at least one electrical device, the fixed desktop portion funthe comprising:

an enclosed electrical access area configured to connect the at least one electrical device to an electrical power source, the eles ess area extending along a length spective one of the at least one backframe transverse post, a foldable desktop portion rotatably connected to the fixed desktop portion, the foldable desktop portion rotatable, in relation to the fixed desktop portion, between a folded position and an unfolded position, the foldable desktop portion in the folded position being parallel to the fixed backframe and perpendicular to the fixed desktop portion, the foldable desktop portion in the unfolded position being coplanar with the fixed desktop portion and perpendicular to the fixed backframe; and at least one support frame rotatably connected to a bottom, vertical portion of the fixed backframe, wherein the at least one support frame comprises:

at least two support frame longitudinal posts generally expending in a longitudinal direction, at least one support frame transverse post connected to the at least two longitudinal support frame posts and generally expending in a transverse direction perpendicular to the longitudinal direction, and at least one support frame diagonal post diagonally connected to the at least two support frame longitudinal posts and to the at least one support frame transverse post wherein the at least one support frame is rotatable between a folded position and an unfolded position, further wherein the at least one support frame in the folded position is releasably connected to the fixed backframe by a first releasable retaining mechanism positioned on a respective one of the at least two support frame longitudinal posts and adjacent the midpoint of the respective one of the at least one backframe transverse post, further wherein the at least one support frame in the folded position positioned adjacent the electrical access area along the length of the electrical access area, further wherein a support frame lower transverse post of the at least one support frame transverse post is misaligned with the at least one backframe transverse post when the at least one on frame is in the folded position.

2. The foldable desk of claim 1, wherein a surface area of the foldable desktop portion is larger than a surface area of the fixed desktop portion.

3. The foldable desk of claim 1, wherein at least one of: the at least one support frame and the fixed backframe comprises at least one independently adjustable foot component at the base, the foot component being capable of being independently raised or lowered and thereby being capable of leveling the foldable desk.

4. The foldable desk of claim 1, wherein the at least one support frame in the folded position is parallel to the fixed backframe and perpendicular to the fixed desktop portion, the at least one support frame in the unfolded position being parallel to the fixed desktop portion and perpendicular to the fixed backframe, wherein the at least one support frame is configured to support the foldable desktop portion from beneath.

5. The foldable desk of claim 4, wherein the foldable desktop portion in the folded position is releasably connected to the at least one support frame in the folded position by a second separate releasable retaining mechanism.

6. The foldable desk of claim 4, wherein the at least one support frame in the unfolded position is releasably connected to the foldable desktop portion in the unfolded position by a third separate releasable retaining mechanism.

7. A method of using a foldable desk, the method comprising the steps of:

rigidly connecting a second portion of a desktop to a fixed backframe, wherein the second portion is a fixed desktop portion sized to accommodate and including a compartment to provide electrical connectivity to an electrical interface accessible through a top of the fixed desktop portion. the electrical interface configured to connect at least one electrical device, the fixed desktop portion further including an enclosed electrical access area configured to connect the at least one electrical device to an electrical power source, wherein the fixed backframe comprises:

at least two backframe longitudinal posts generally expending in a longitudinal direction, at least one backframe transx se post connected to the at least tw backframe longitudinal posts and generally expending in transverse direction perpendicular to the longitudinal direction, the electrical access area extending along a length of a respective one of the at least one backframe transverse post, and two backframe diagonal post diagonally connected to the at least two backframe longitudinal posts and to the at least one backframe transverse post, the two backframe diagonal posts converging at a fastener positioned at a midpoint respective one of the at least one backframe transverse post;

rotating a first portion of the desktop relative to the second portion of the desktop such that the first portion and the second portion are coplanar;

rotating at least one support frame about at least one axis perpendicular to the first and the second portions; and supporting the first portion of the desktop with the at least one support frame, wherein the at least one support frame comprises:

at least two support frame longitudinal posts generally expending in a longitudinal direction, at least one support frame transverse post connected to the at least two longitudinal support frame posts and generally expending in a transverse direction perpendicular to the longitudinal direction, and at least one support frame diagonal post diagonally connected to the at least two support frame longitudinal posts and to the at least one support frame transverse post, wherein the at least one support frame is rotatable between a folded position and an unfolded position, further wherein the at least one support frame in the folded position is releasably connected to the fixed backframe by a first releasable retaining mechanism positioned on a respective one of the at least two support frame longitudinal posts and adjacent the midpoint of the respective one of the at least one backframe transverse post, further wherein the at least one support frame in the folded position positioned adjacent the electrical access area along the length of the electrical access area, further wherein a support frame lower transverse post of the at least one support frame transverse post is misaligned with the at least one backframe transverse post when the at least one support frame is in the folded position.

8. The method of claim 7 further comprising electrically connecting a power cord to the electrical interface.

9. The method of claim 7, further comprising releasably connecting the at least one support frame to the fixed backframe.

10. The method of claim 7, wherein a surface area of the first portion of the desktop is larger than a surface area of the second portion of the desktop.

11. The method of claim 7 further comprising independently raising or lowering at least one corner of the at least one support frame to level the foldable desk.

12. The method of claim 7, wherein supporting the first portion of the desktop with the at least one support frame comprises releasably connecting the at least one support frame to the first portion of the desktop.

13. The method of claim 7 further comprising:

releasing the first portion of the desktop from the support of the at least one support frame;

rotating the at least one support frame about the at least one axis such that the at least one support frame and the second portion are perpendicular;

rotating the first portion of the desktop relative to the second portion of the desktop such that the first portion and the second portion are perpendicular.

14. The method of claim 13 further comprising releasably connecting the first portion of the desktop to the at least one support frame.

* * * * *